United States Patent [19]

Güell

[11] 4,038,839

[45] Aug. 2, 1977

[54] TAKE-UP APPARATUS

[75] Inventor: José María Dalmau Güell, Barcelona, Spain

[73] Assignee: Jumberca, S.A., Badalona, Spain

[21] Appl. No.: 684,844

[22] Filed: May 10, 1976

[30] Foreign Application Priority Data

May 13, 1975 Spain ..... 437639

[51] Int. Cl.[2] ..... D04B 15/88

[52] U.S. Cl. ..... 66/151

[58] Field of Search ..... 66/151, 152, 153; 139/304

[56] References Cited

U.S. PATENT DOCUMENTS

| | | | |
|---|---|---|---|
| 265,296 | 10/1892 | Adgate | 66/151 |
| 2,497,786 | 2/1950 | Miller | 66/152 |
| 2,710,530 | 6/1955 | Burdett | 66/153 |
| 3,760,609 | 9/1973 | Pooeza et al. | 66/152 X |

FOREIGN PATENT DOCUMENTS

| | | | |
|---|---|---|---|
| 1,359,721 | 7/1974 | United Kingdom | 66/153 |

*Primary Examiner*—Mervin Stein
*Assistant Examiner*—Andrew M. Fable
*Attorney, Agent, or Firm*—Staas & Halsey

[57] ABSTRACT

The invention discloses an apparatus for tensioning and taking-up the fabric emerging from a circular knitting machine and which comprises four rollers having parallel and essentially coplanar shafts. There are means for moving three of the rollers transversally, the non-movable roller being mechanically connected to the rotary movement of the knitting machine to cause its rotation.

7 Claims, 6 Drawing Figures

TAKE-UP APPARATUS

BACKGROUND OF THE INVENTION

1. Field of the Invention

The present invention relates to an apparatus for the tensioning and taking-up of fabric emerging from a circular knitting machine having a wave shaped annular cam track. In such machines, two cloth layers are formed by the superimposition of the two symmetrical halves of the fabric leaving the circular knitting machine in tubular form. With the present invention the fabric is taken up free from the deforming tensions which result from the effects of the two cloth layers on the tensioning device rollers.

SUMMARY OF THE INVENTION

The present invention is designed to prevent the formation of asymmetrical tensions in the tensioning of the fabric. The foregoing is possible because of the symmetrical treatment to which the fabric is subjected as it passes through four rollers wherein both faces of the fabric are successively equally treated resulting in achieving a balance and levelling of the tensions.

The apparatus comprises a first transversally movable rotatory roller, a second rotatory roller and third and fourth transversally movable rotatory rollers, the respective shafts of which are parallel and substantially-coplanar, the rollers being adapted to occupy a first position in which they are spaced apart from one another and a second position in which they are adjacent to one another, each roller having attached thereto a coaxial gear wheel or pinion so that in the second position the second roller pinion may mesh with the first and third roller pinions and the third roller pinion with the fourth roller pinion, mechanism for causing the rollers to move from one to the other of the positions, including levers which operating against springs act on the shafts of the first and third rollers moving same transversely in opposite directions relative to the second roller and a lever operating against the force of a spring for moving the fourth roller transversely relative to the third roller, A ratchet wheel coaxially affixed to the second roller, a primary driving lever and a secondary driving lever mounted coaxially but not fixedly to the second roller, the wave-shaped annular track of the circular knitting machine bearing against a first end of said first lever thereby causing it to oscillate and transmit such oscilations through the other end thereof to the secondary driving lever which is pulled in turn by one or more springs tending to maintain it in mechanical contact with the primary lever and having moreover a feed pawl adapted to act on the ratchet wheel so that in one period of its oscillation the primary lever causes said secondary lever to move through the other end thereof tensioning the spring and sliding its pawl along the ratchet wheel while in a second period of oscillation the spring causes opposite movement of the secondary lever, the feed pawl then acting on the ratchet wheel to cause rotation of the second roller, An emerging fabric take-up station, all so arranged that the tubular fabric emerging from the loom enters in the apparatus between the first and second rollers, successively wraps half the periphery of the second and third rollers and exits between the third and fourth rollers towards said take-up station.

BRIEF DESCRIPTION OF THE DRAWINGS

Other objects and features of the invention will be disclosed in detail in the following description with reference to the accompanying drawing, in which.

DESCRIPTION OF THE PREFERRED EMBODIMENT

Figure 1:
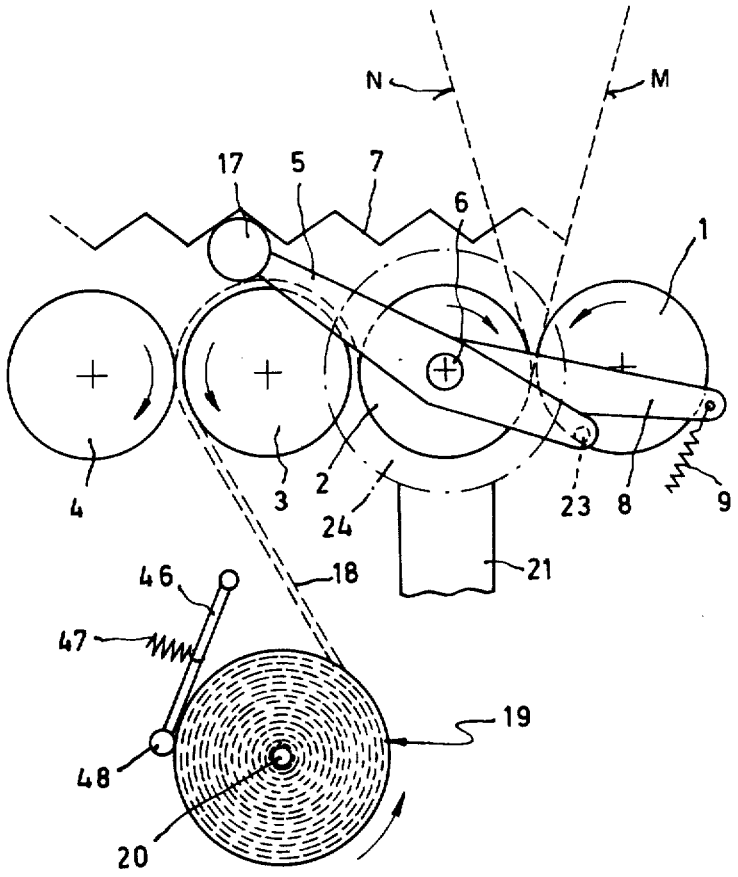
FIG. 1 is a diagrammatic elevation view from one end of the mechanism for operation of the cloth tensioning device.
Figure 2:
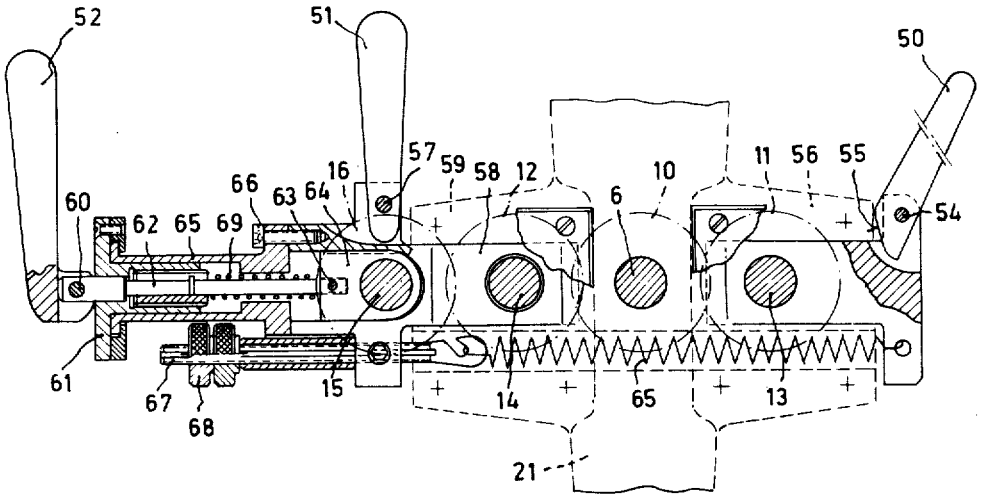
FIG. 2 illustrates the mechanism for separation of the tensioning device rollers.
Figure 4:
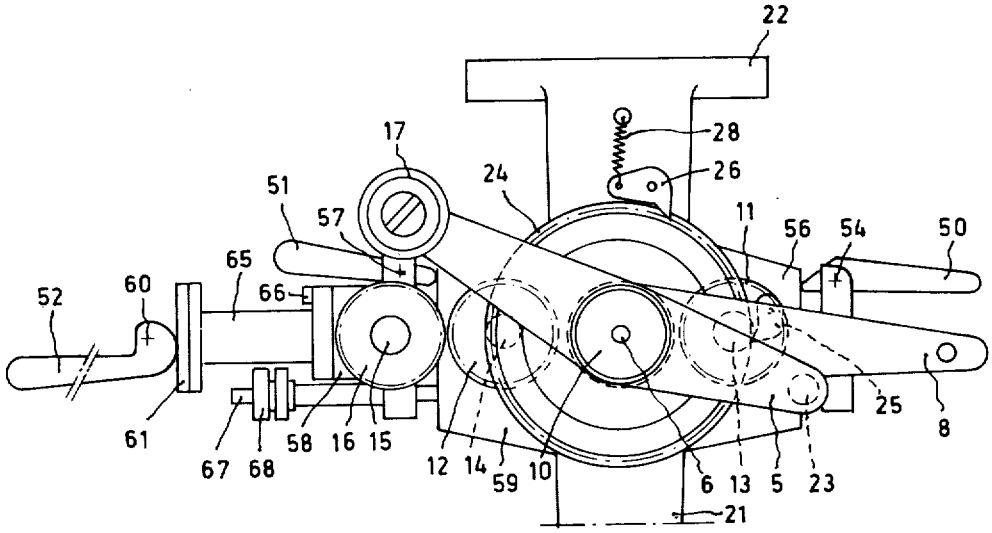
FIG. 4 is a fragmentary view in longitudinal section of the tensioning device showing the rollers separated one from another.
Figure 3:
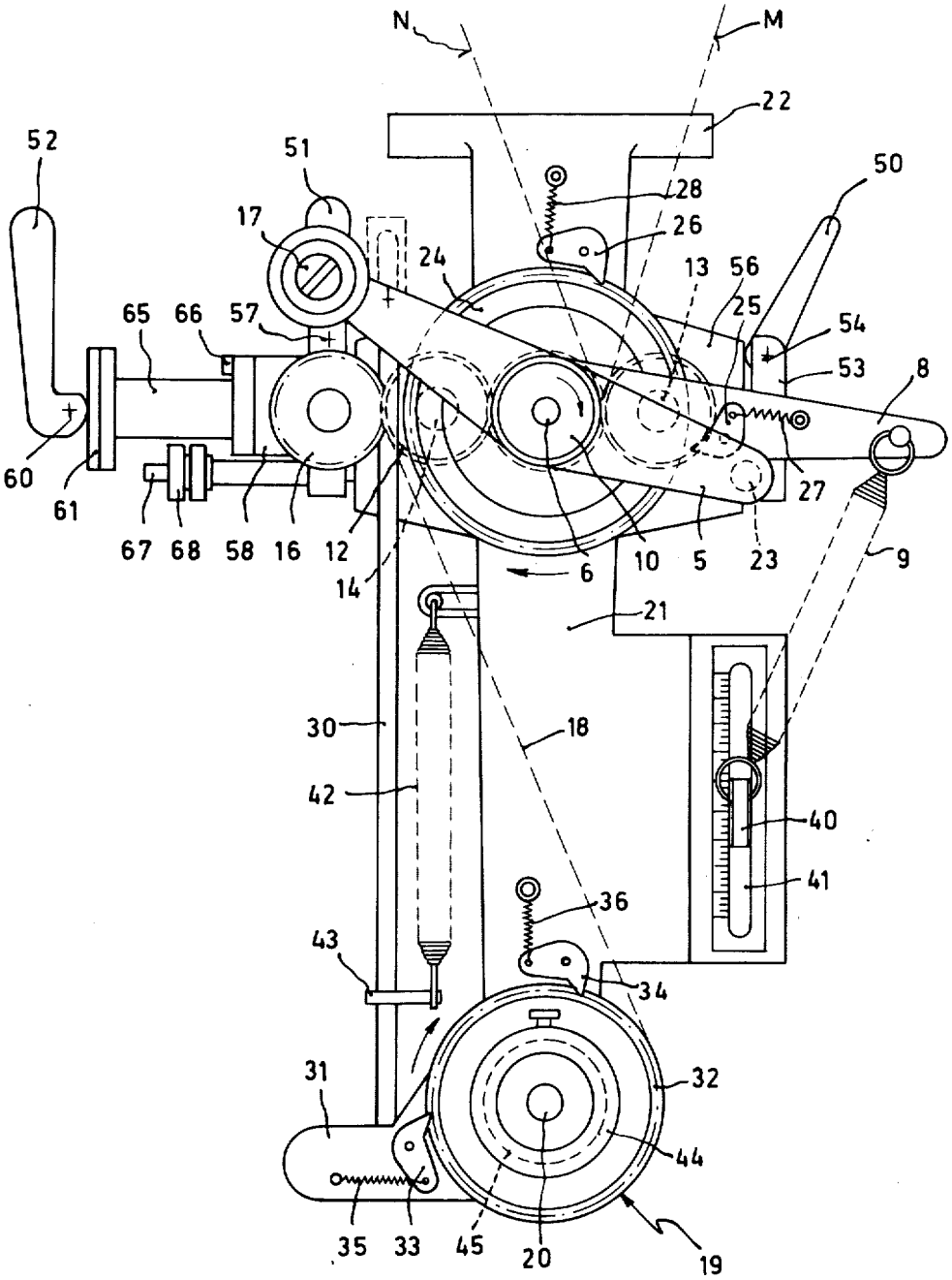
FIG. 3 is a view in longitudinal section of the tensioning and take-up motion in the operative position.
Figure 5:
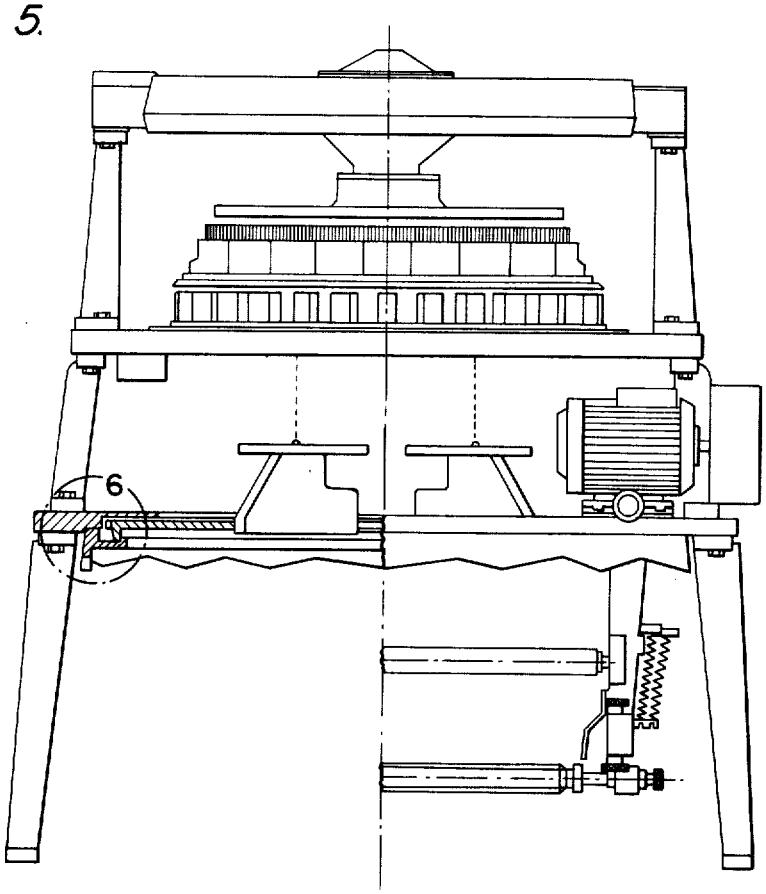
FIG. 5 is a front elevational view partly in section of a circular knitting machine.
Figure 6:
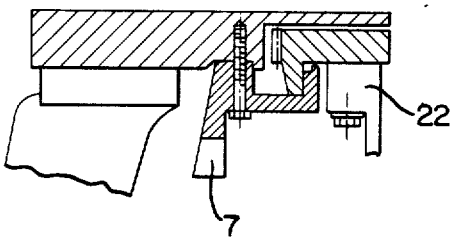
FIG. 6 is an enlarged fragmentary view of that part of the circular knitting machine of FIG. 1, illustrating in particular the annular track on the circular knitting machine and the upper plate attached to the machine.

Essentially the apparatus according to the present invention comprises four rollers 1, 2, 3 and 4 consistuting the tensioning device which are associated one with another through an operating mechanism comprising a primary driving lever 5 mounted on the shaft 6 of roller 2 but not affixed thereto and engaging the wave-shaped annular cam track 7 of the knitting machine, a secondary driving lever 8 mounted on the shaft 6 but not affixed thereto and coupled to springs 9. Shaft 6 carries gear wheel or pinion 10 which meshes with pinions 11 and 12 attached respectively to shafts 13 and 14 of rollers 1 and 3. Shaft 15 of roller 4 also has a pinion 16 meshing with the pinion 12 of roller 3.

Primary driving lever 5 engages annular track 7 through a roller 17. Rollers 1, 2, 3 and 4 have a cylindrical metal core and are covered by such materials as rubber, plastics or other material having appropriate properties. The fabric 18 emerging from the knitting machine enters the tensioning device and is engaged by rollers 1, 2, 3 and 4 thereof. At the exit of the device the fabric 18 is taken up by a beam 19 mounted on a shaft 20 in a support 21 of the device which is attached to the knitting machine by way of an upper plate 22.

The primary driving lever 5 is provided with a laterally extending boss 23 bearing against the lower edge of secondary driving lever 8 for operation thereof. A ratchet wheel 24 is permanently attached to shaft 6 and a feed pawl 25 affixed to secondary driving lever 8 and a check pawl 26 provided with respective springs 27 and 28, are adapted to act on the ratchet wheel 24.

Beam 19 is driven from primary driving lever 5 by a crank 30 through an arm 31 mounted to shaft 20 of the beam 19. Shaft 20 is provided with a ratchet wheel 32 having feed and check pawls 33 and 34 provided with springs 35 and 36, respectively.

The operating tensions of the apparatus with respect to the fabric 18 are obtained by adjusting the length of the springs 9 of the lever 8 by way of their corresponding anchoring arm which slides in a graduated slot 41. In turn, the crank 30 of beam 19 is provided with a spring 42 attached to an adjustable sliding member 43. Beam 19 is provided with a cylindrical core which may be removed from shaft 20 by operation of a knob 44 attached to a gear wheel 45 and capable of removal in an axial direction.

An additional tension device (FIG. 1) for the beam 19 comprises a hinged lever 46 urged by a spring 47 allowing for compensation of the effort of the tension device of crank 30. Lever 46 is provided with a roller 48 bearing on the full width of the fabric 18 when applied against the beam 19.

To separate the rollers 1, 2, 3 and 4 one from the other, there is a mechanism comprising three levers 50, 51 and 52. Lever 50 is hinged to a head 53 wherein there is mounted shaft 13 of roller 1, rotates around a shaft 54 and is provided with a cam surface 55 which bears against a fixed portion 56. Lever 51 rotates about a shaft 57 of head 58 and bears likewise against a fixed portion 59 so that when levers 50 and 51 are operated they allow the heads 53 and 58 to be moved whereby the rollers 1 and 3 are separated from roller 2 which is fixed. Lever 52 rotates around a shaft 60 and bears against a camming surface 61 to move a rod 62 connected through the medium of a pin 63 to an inner core 64 carrying the shaft 15 of the roller 4 so as to be able to separate roller 4 from roller 3. Rod 62 is housed in a body member 65 bolted as at 66 to the head 58.

The above described separation mechanism also comprises recovery means consisting of a tension spring 65 mounted between heads 53 and 58 to counteract the action of levers 50 and 51. Spring 65 is adjustable with a threaded pin 67 provided with lock nuts 68, while a further spring 69 opposes the action of lever 52 on rod 62.

The basic operation of the apparatus is in the drive of rollers 1, 2, 3 and 4, to which effect the primary drive lever 5 so engages the profiles of the annular track 7 that each time the primary lever descends the secondary lever is caused to rise against the urging of springs 9, while the feed pawl 25 slides over the ratchet wheel 24, while each time the lever 5 rises, springs 9 contract and cause the ratchet wheel 24 to rotate through the medium of feed pawl 25, and, consequently, shaft 6 and pinion 10 are caused to rotate, this movement being transmitted to the remaining pinions 11, 12 and 16. Thereby the four rollers 1, 2, 3 and 4 rotate to feed the fabric 18, with such movements taking place in rapid succession.

This apparatus is timed to operate in synchronism with the knitting machine, both with respect to the fabric feed and to joint rotation. The fabric enters downwardly between rollers 1 and 2 with its face M bearing against roller 2 and passes upwardly between rollers 2 and 3, after which face N bears against roller 3, and then downwardly again between rollers 3 and 4, after which the fabric 18 is directed towards the beam 19.

The outstanding property of the above described apparatus consists in preventing the formation of assymetrical tensions in the tensioning of the fabric 18 which is possible because of the symmetrical treatment to which it is subjected on its passage through the four rollers, whereby both faces M and N are successively equally treated, resulting in a balance and levelling of such tensions.

What I claim is:

1. An apparatus for taking up the fabric emerging from a circular knitting machine having a wave-shaped annular camtrack, said apparatus comprising a first transversally movable rotatory roller, a second rotatory roller and third and fourth transversally movable rotatory rollers, the respective shafts of which are parallel and substantially coplanar, said rollers being adapted to occupy a first position in which they are spaced apart from one another and a second position, in which they are adjacent to one another, each roller having attached thereto a coaxial gear wheel or pinion so that in said second position, the second roller pinion may mesh with the first and third roller pinions and the third roller pinion with the fourth roller pinion, means for causing the rollers to move from one to the other of said positions, a ratchet wheel coaxially affixed to said second roller, a primary driving lever and a secondary driving lever, mounted coaxially but not fixedly to said second roller, a first lever, said wave-shaped annular track of the circular knitting machine bearing against one end of said first lever, thereby causing it to oscillate and transmit such oscillations through the other end thereof to the secondary driving lever, which is pulled in turn by one or more springs tending to maintain it in mechanical contact with said primary lever and having moreover a feed pawl adapted to act on the ratchet wheel so that in one period of its oscillation said primary lever causes said secondary lever to move through said other end thereof tensioning the spring and sliding its pawl along the ratchet wheel while in a second period of oscillation, said spring causes opposite movement of the secondary lever, said feed pawl then acting on the ratchet to cause rotation of said second roller, an emerging fabric take-up station, all so arranged that the tubular fabric emerging from the circular knitting machine enters in the nip between the first and second rollers, successively wraps half the periphery of the second and third rollers and exits between the third and fourth rollers towards said take-up station.

2. Apparatus according to claim 1, wherein said fabric take-up station comprises a beam driven by a crank attached to a primary drive lever, whereby said crank communicates its oscillations to said beam whereby the latter rotates stepwise in synchronisation with said second roller.

3. An apparatus according to claim 2, wherein said beam is provided with a ratchet wheel on its rotating shaft engaging feed and check pawls for control of movement of said beam.

4. An apparatus according to claim 1, wherein said rollers are caused to move from one position to another thereof by levers which, operating against the urging of springs, act on respective heads comprising the first and third shafts respectively, thereby moving them transversally in opposite directions relative to the fixed second roller shaft, while the fourth roller is transversally moveable relative to the third roller by a further lever which operates against the force of a spring, said second position of the rollers being recovered by said springs on removal of the lever action.

5. An apparatus according to claim 1, wherein said spring attached to said secondary drive lever is adjustable by an adjustable position anchor member in accordance with a graduated scale, to communicate a greater or lesser take down tension to the fabric.

6. An apparatus according to claim 2 wherein the beam take-up tension is obtained by a spring attached to the drive crank and provided with tension adjustment means.

7. An apparatus according to claim 2, wherein said beam has an auxiliary tension device for compensating the take-up tension stress, comprising a lever resiliently pressing against the fabric over the whole width thereof when starting take-up.

* * * * *